US006158565A

United States Patent [19]

Mikami et al.

[11] Patent Number: 6,158,565

[45] Date of Patent: Dec. 12, 2000

[54] BILL PROCESSOR

[75] Inventors: Mitsugu Mikami, Kawagoe; Tadashi Hatamachi, Higashi-Matsuyama, both of Japan

[73] Assignee: Kabushiki Kaisha Nippon Conlux, Tokyo, Japan

[21] Appl. No.: 09/140,287

[22] Filed: Aug. 25, 1998

[30] Foreign Application Priority Data

Aug. 28, 1997 [JP] Japan ..... 9-232424
Sep. 5, 1997 [JP] Japan ..... 9-241171

[51] Int. Cl.[7] ..... G07D 7/00

[52] U.S. Cl. ..... 194/206; 194/350

[58] Field of Search ..... 194/206, 207, 194/350; 271/177, 180, 181

[56] References Cited

U.S. PATENT DOCUMENTS

| | | | |
|---|---|---|---|
| 4,678,072 | 7/1987 | Kobayashi et al. | 194/206 |
| 4,784,274 | 11/1988 | Mori et al. | 209/534 |
| 4,880,096 | 11/1989 | Kobayashi et al. | 194/206 |
| 5,505,439 | 4/1996 | Watabe et al. | 271/177 |
| 5,564,691 | 10/1996 | Hatamachi et al. | 271/178 |
| 5,639,081 | 6/1997 | Hatamachi et al. | 271/177 |

*Primary Examiner*—F. J. Bartuska
*Attorney, Agent, or Firm*—Hogan & Hartson, LLP

[57] ABSTRACT

A bill processor having pivotally supported parts for easy maintenance. The bill processor includes a machine body, a bill conveyer disposed in the body for conveying a bill along a bill passage, and a front mask having a bill insertion port and disposed on the front of the body. The bill processor also has a bill identification device disposed on the bill passage for determining the genuineness of the inserted bills, as well as a bill stacker. In one bill processor, the conveyer is supported via a shaft to be freely pivotable toward the front of the machine body, and a front mask is supported to be freely pivotable with respect to the machine body. In another bill processor, a support structure is provided for supporting the machine body including the conveyer and the bill stacker so the machine body is freely pivotably supported with respect to the front mask and freely detachably engaged to the front mask. A pivot stopper structure is provided and includes a pivot guiding groove formed on the front mask and a shaft protruding from the machine body and inserted in the pivot guiding groove for adjusting a pivot angle of the machine body with respect to the front mask, and a notch on the front mask for guiding the shaft into the pivot guiding groove.

13 Claims, 15 Drawing Sheets

BILL PROCESSOR

BACKGROUND OF THE INVENTION

1. Field of the Invention

The invention relates to an improvement of a bill processor used for automatic vending machines, money-changing machines, or service equipment such as pinball dispensing machines and token dispensing machines.

2. Description of the Related Art

Generally, some of automatic vending machines, money-changing machines, and service equipment such as pinball dispensing machines and token dispensing machines are provided with a so-called bill processor, which determines truth or falsehood of inserted bills and accumulates genuine bills in a stacker.

FIG. 13 is a schematic side view of a conventional bill processor described above.

This conventional bill processor 1 sends a bill inserted through a bill insertion port 3 along an inverted U-shaped bill passage 12 (a dash and dotted line) by bill conveying means 15, determines truth or falsehood of the inserted bill by bill identification means 31, and if it is judged that the inserted bill is counterfeit, reverses the bill conveying means 15 to return the inserted bill through the bill insertion port 3, but if it is judged by the bill identification means 31 that the inserted bill is not counterfeit, keeps driving the bill conveying means 15 to send the bill downward of a machine body 6, and accumulates the bill into an unillustrated stacker.

The above-described conventional bill processor 1 comprises the machine body 6 consisting of a housing, the bill conveying means 15, which is disposed in the machine body 6, consists of a conveying belt 25 for conveying a bill along the bill passage 12 formed in the machine body 6 and is supported by a shaft 21 to be freely rotatable toward a front 6*a* of the machine body 6, a front mask 2 having the bill insertion port 3 and detachably mounted on the front 6*a* of the machine body 6, and the bill identification means 31 such as a photosensor disposed on the bill passage 12.

The front mask 2 has the bill insertion port 3 on its front to communicate with the bill passage 12 and a pair of first idle rollers 4 freely rotatably supported on its back side so to be forcedly contacted to the conveying belt 25 running around a pair of vertically mounted pulleys 23, 24 to configure the bill conveying means 15.

The front mask 2 is directly mounted on the front 6*a* of the machine body 6 by screws 5 with a tool such as a screwdriver.

In the machine body 6 consisting of the housing are disposed a holder 8 which is supported by a shaft 7 to be freely rotatable toward the backside of the machine body 6 and an unillustrated stacker for accommodating bills sent from downstream of the inverted U-shaped bill passage 12.

A drive motor 9 is disposed in the holder 8 to drive the bill conveying means 15, and a pair of second idle rollers 10 are also freely rotatably supported to be forcedly contacted to the conveying belt 25 of the bill conveying means 15.

The holder 8 is, in its initial position as shown in FIG. 13, positioned and supported at the upper part of the machine body 6 by latch means 11 which is disposed on the top of the machine body 6.

Unillustrated power transmitting means is disposed in the above-described machine body 6 to transmit a drive force of the drive motor 9 disposed in the holder 8 to the lower pulley 24 of the bill conveying means 15.

The bill conveying means 15 comprises the upper pulley 23 and the lower pulley 24 which are disposed on a supporting plate 22 supported by the shaft 21 to be freely pivotable toward the front 6*a* of the machine body 6 and the conveying belt 25 running around the upper pulley 23 and the lower pulley 24. And, the supporting plate 22 in its initial position as shown in FIG. 13 is positioned and supported at the middle position of the machine body 6 by the unillustrated latch means.

According to the bill conveying means 15 as described above, the drive motor 9 in the holder 8 is driven to transmit the power to the lower pulley 24 through the unillustrated power transmitting means of the machine body 6, the conveying belt 25 is rotated in a clockwise or counterclockwise direction, and the first idle rollers 4 and the second idle rollers 10 which are in forced contact with the conveying belt 25 are also rotated in a counterclockwise or clockwise direction according to the rotation of the conveying belt 25.

Therefore, when the drive motor 9 is driven, a bill held between the conveying belt 25 of the bill conveying means 15 and the first idle rollers 4 or between the conveying belt 25 and the second idle rollers 10 is conveyed along the bill passage 12 to downstream or upstream of the bill passage 12.

The bill identification means 31 is a photosensor for judging truth or falsehood of the bill while it is passing and comprises a light emitting diode 31*a* disposed between the upper pulley 23 and the lower pulley 24 and a light receiving diode 31*b* disposed between the second idle rollers 10.

The light emitting diode 31*a* and the light receiving diode 31*b* are opposed to each other with the bill passage 12 therebetween and are partly exposed to the bill passage 12.

Meanwhile, in the bill processor 1, the conveying belt 25 holds the bill with the first idle rollers 4 and the second idle rollers 10 to convey it and worn due to friction with the bills. If the conveyor belt 25 is worn excessively, the bills are not conveyed at a stable speed, and the bill may be stuck or not accurately judged to be truth or falsehood.

Therefore, as shown in FIG. 14, the above-described conventional bill processor 1 is configured so that maintenance and inspection works can be performed as required by removing the front mask 2 from the machine body 6 with a tool such as a screwdriver, exposing the bill conveying means 15 by pivoting the supporting plate 22 about the shaft 21 in a counterclockwise direction, and replacing the conveying belt 25 configuring the bill conveying means 15 or cleaning the photosensor as the bill identification means 31.

Since the above-described conventional bill processor 1 is configured to have the front mask 2 directly mounted on the machine body 6 by screws 5 or the like, the maintenance or inspection work to replace the conveyor belt 25 of the bill conveying means 15 is troublesome, because it is necessary to use a tool such as a screwdriver to remove the screws 5 in order to remove the front mask 2 from the machine body 6 as shown in FIG. 14.

As shown in FIG. 15, when the bill identification means 31 is cleaned by pivoting the holder 8 in a clockwise direction about the shaft 7 with the front mask 2 mounted on the machine body 6 to expose the bill passage 12, a work space provided above the bill passage 12 is not large enough to insert a cleaning tool such as a cotton swab to remove dirt from the light emitting diode 31*a* and the light receiving diode 31*b* and to fully clean them.

Conventional bill processors include a so-called single escrow type bill processor which, similar to the above-described conventional bill processor, holds one bill in the bill passage until merchandise is dispensed and stores the held bill in the stacker, and a so-called three escrow type bill processor which holds three bills until merchandise is dispensed and stores the held bills into the stacker.

There is also a so-called payment type bill processor which can dispense bills from those accumulated in a stacker through a bill conveying port.

These various types of bill processors have a different size depending on their functions. And, they are configured, for example, as shown in FIG. 13 through FIG. 15, that the front mask 2 having the bill insertion port 3 and the machine body 6 having various functions such as the above-described temporary holding, stacking of bills, and dispensing of bills from the unillustrated stacker are fixed into one body.

According to these conventional various types of bill processors, when the bill processor mounted on the service equipment was to be changed to a different type, for example, when the one escrow type bill processor was changed to the three escrow type bill processor, since these two types of bill processors had a different size, the front door of the service equipment to which the bill processor was mounted must be changed to a type suitable for the individual type of bill processor, and such a job was troublesome.

SUMMARY OF THE INVENTION

It is a first object of the invention to provide a bill processor, in which it is easy to change a conveying belt of bill conveying means, to clean bill identification means and to perform maintenance and inspection of them.

To achieve the first object of the invention, a bill processor according to the first aspect of the invention comprises: a machine body configured of a housing; bill conveying means comprising a conveying belt disposed within the machine body for conveying a bill along a bill passage formed within the machine body and being supported to be freely pivotable via a shaft toward a front side of the machine body; and a front mask disposed on the front side of the machine body for covering the bill conveying means, the front mask having a bill insertion port for guiding an inserted bill to the bill conveying means and being supported to be freely pivotable with respect to the machine body.

It is an object of a second aspect of the invention to provide a bill processor which is easily changeable to a different type of bill processor.

To achieve the object of the second aspect of the invention, a bill processor according to the second aspect of the invention comprises: at least a machine body configured of a housing which includes at least a bill passage, bill conveying means for conveying a bill along the bill passage, and a stacker for holding genuine bills therein, in which truth or falsehood of the inserted bill conveyed along the bill passage is judged and genuine bills are accummulated in the stacker; and a front mask which has a bill insertion port communicating with the bill passage and which covers a front side of the machine body, wherien the bill processor further comprises supporting means for freely pivotably supporting the machine body with respect to the front mask and freely detachably supporting the machine body with respect to the front mask.

Other objects and effects of the invention will be apparent from the following detailed description and the accompanying drawings.

DESCRIPTION OF THE PREFERRED EMBODIMENTS

A bill processor according to a first aspect of the invention and a bill processor according to a second aspect of the invention will be described in detail.

Figure 1:
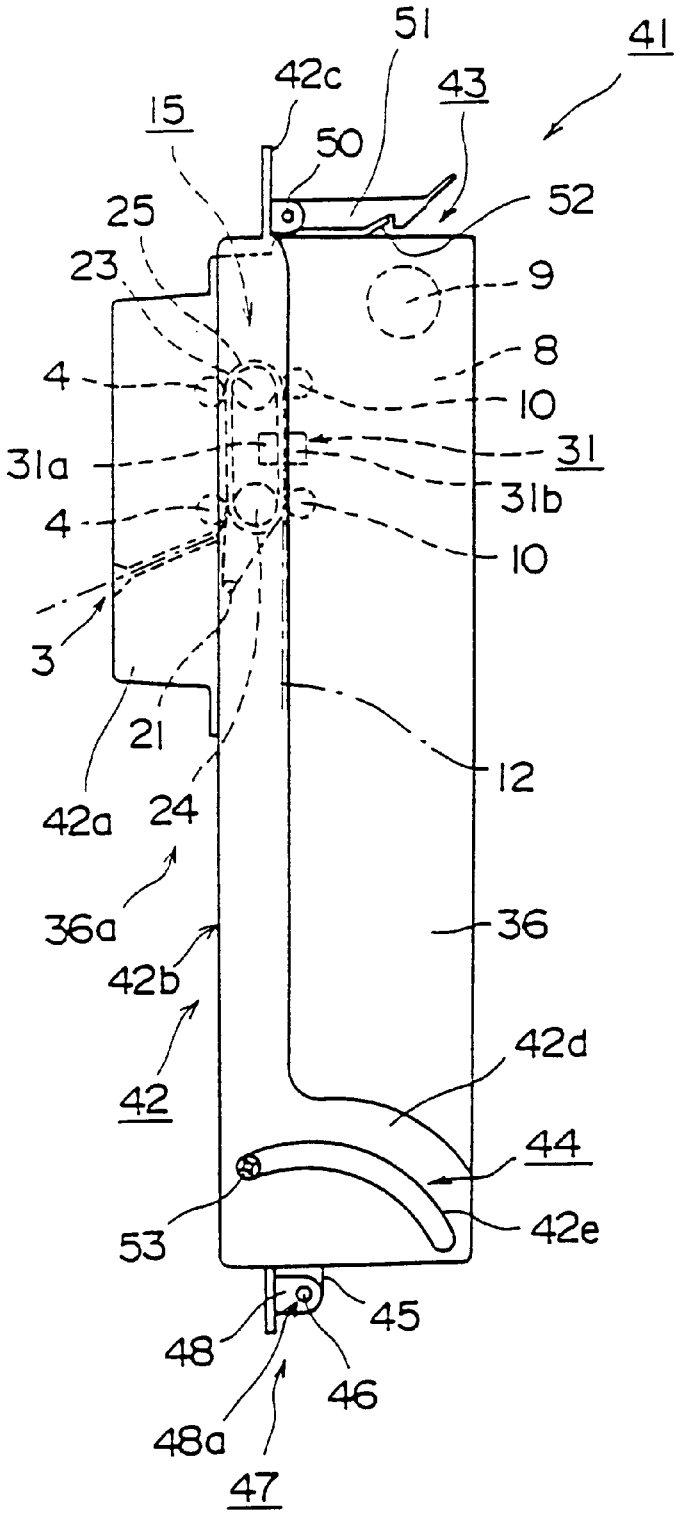
FIG. 1 is a perspective plan view of a bill processor according to a first aspect of the invention.
Figure 13:
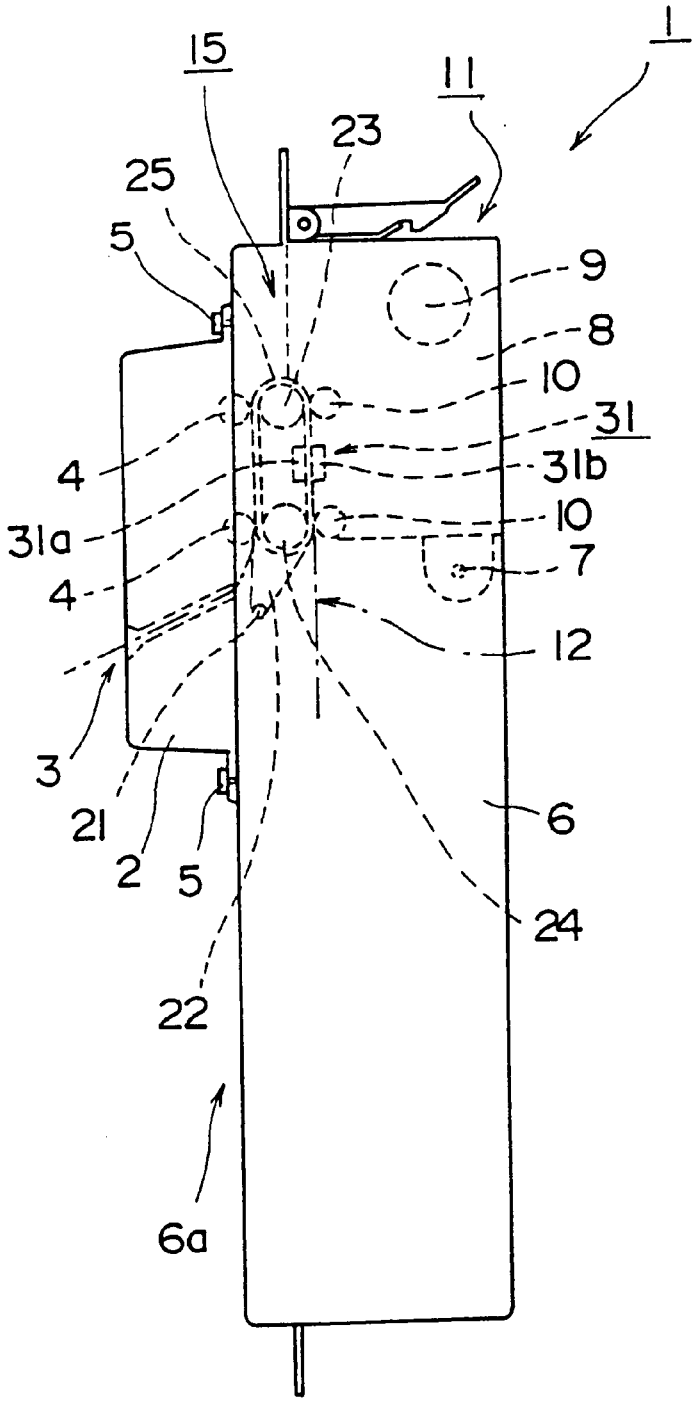
FIG.13 PRIOR ART
FIG. 13 is a perspective plan view of a conventional bill processor.

As shown in FIG. 1, in which the same components as in FIG. 13 are indicated by the same numerals, a bill processor 41 according to the first aspect of the invention comprises a machine body 36 made of a rectangular housing, a bill conveying means 15, which is disposed in the machine body 36, consists of a conveying belt 25 for conveying a bill along a bill passage 12 formed in the machine body 36 and is supported by a shaft 21 to be freely pivotable toward a front 36*a* of the machine body 36, a front mask 42 formed on the front 36*a* of the machine body 36 to cover the bill conveying means 15 and also supported to be freely pivotable with respect to the machine body 36, latch means 43 disposed between the front mask 42 and the machine body 36 to detachably mount the front mask 42 onto the machine body 36, and pivot stopper means 44 disposed between the front mask 42 and the machine body 36 to adjust a pivoting angle of the front mask 42 with respect to the machine body 36.

The machine body 36 consisting of the housing comprises the inverted U-shaped bill passage 12, an unillustrated stacker for accommodating bills downstream of the bill passage 12, and a drive motor 9 for driving the bill conveying means 15. The machine body 36 supports in its housing to freely rotate two second idle rollers 10 which are forced to contact their outer faces to the conveying belt 25 of the bill conveying means 15 disposed in the machine body 36.

The machine body 36 also has unillustrated power transmitting means for transmitting the drive force of the drive motor 9 in the housing to a lower pulley 24 of the bill conveying means 15.

The machine body 36 also has a pair of ribs 45 formed to oppose to each other at the bottom end and a shaft 46 held between the ribs 45.

The front mask 42 comprises a bill insertion part 42*a* and a frame 42*b*, which has the bill insertion part 42*a* fixed and a substantially U-shaped cross section. The frame 42*b* is freely pivotably supported by frame supporting means 47 disposed at the bottom end of the machine body 36 to wholly cover the front 36*a* of the machine body 36.

In the front mask 42, the bill insertion part 42*a* has a bill insertion port 3 communicated with the bill passage 12 of the machine body 36 and freely rotatably supports the first idle rollers 4 on its back.

The frame 42*b* of the front mask 42 fixes the bill insertion part 42*a* and forces to contact the outer surfaces of the first idle rollers 4 to the conveying belt 25 of the bill conveying means 15 in the initial position shown in FIG. 1. And, the frame 42*b* has on its top end a handle 42*c* for supporting a shaft 50 and at its lower part a pair of tongue pieces 42*d* which are opposed to each other.

The frame supporting means 47 is disposed at the bottom end of the front mask 42 and consists of a pair of ribs 48 which are opposed to each other. A shaft insertion hole 48*a* is formed on side walls of the ribs 48, in which the shaft 46 which is held by the ribs 45 of the machine body 6 is inserted.

According to the frame supporting means 47, by inserting the shaft 46 held by the ribs 45 into the shaft insertion holes 48*a* of the ribs 48, the frame 42*b* of the front mask 42 is freely pivotably supported by the shaft 46 disposed on the machine body 36. Thus, the front mask 42 is supported by the shaft 46 to be freely pivotable with respect to the machine body 36.

The latch means 43 on the top end of the front mask 42 comprises an engaging hook 51 which is supported by the shaft 50 to be freely pivotable with respect to the frame 42*b* and an engaging member 52 which is disposed on the top end of the machine body 36 to engage with the engaging hook 51.

By the latch means 43, the front mask 42 in the initial position shown in FIG. 1 is positioned and supported in a state to cover the machine body 36.

The pivot stopper means 44 comprises a shaft 53 which is disposed to protrude at a lower part of the machine body 36 and a pivot guide groove 42*e* in a circular arc shape for inserting the shaft 53 therein, and the pivot guide groove 42*e* is formed on the individual tongue piece 42*d* of the frame 42*b*.

Action of the bill processor 1 according to the first aspect of the invention will be described.

Figure 2:
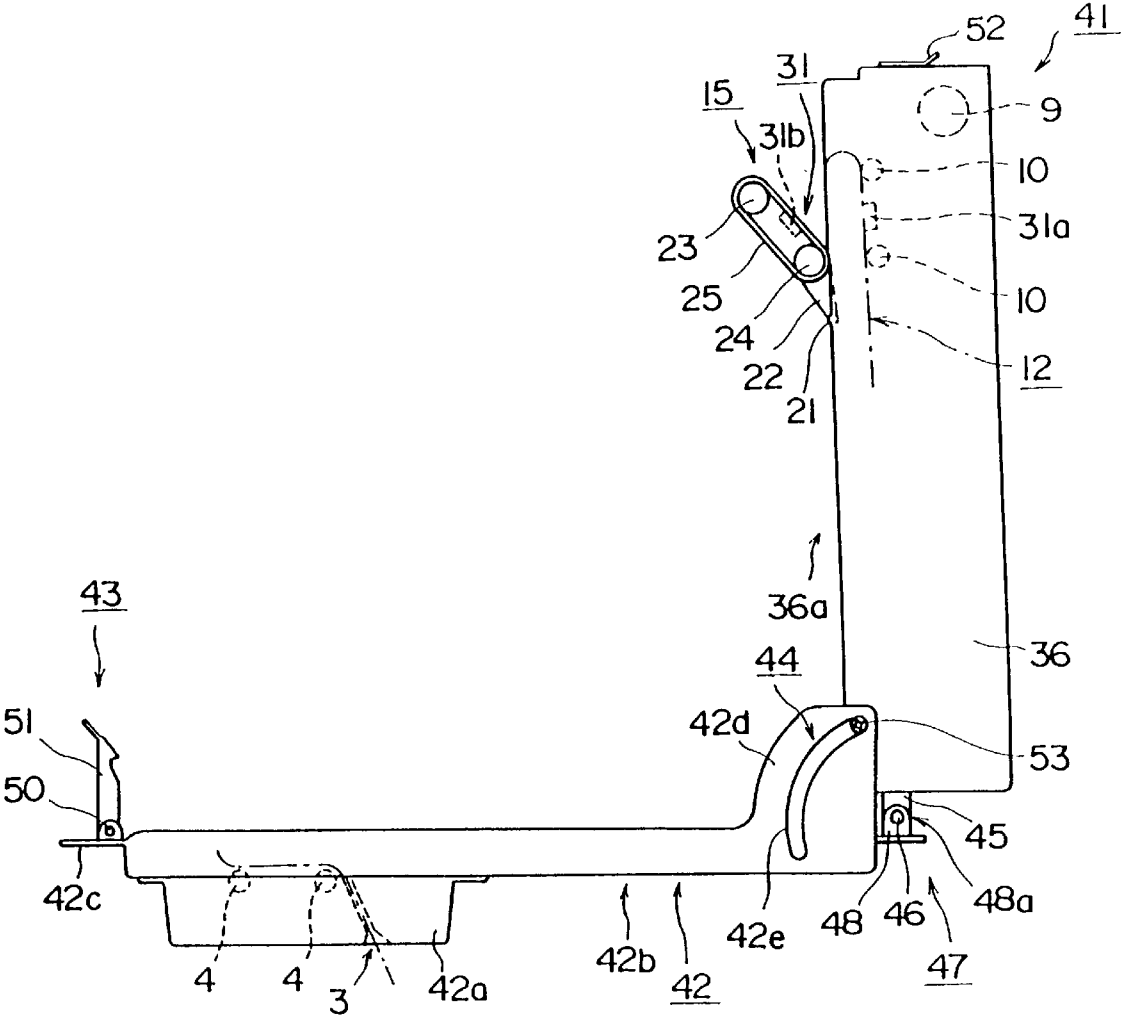
FIG. 2 is a perspective plan view showing operation of the bill processor according to the first aspect of the invention.

According to the bill processor 1 described above, when the conveying belt 25 of the bill conveying means 15 is changed or when the photosensor as the bill identification means 31 is cleaned, the engaging hook 51 is pivoted in a counterclockwise direction about the shaft 50 to release the engagement of the latch means 43, and the handle 42*c* of the front mask 42 is gripped to pivot the front mask 42 in a counterclockwise direction about the shaft 46. Thus, the front 36*a* of the machine body 36 is exposed as shown in FIG. 2.

Figure 14:
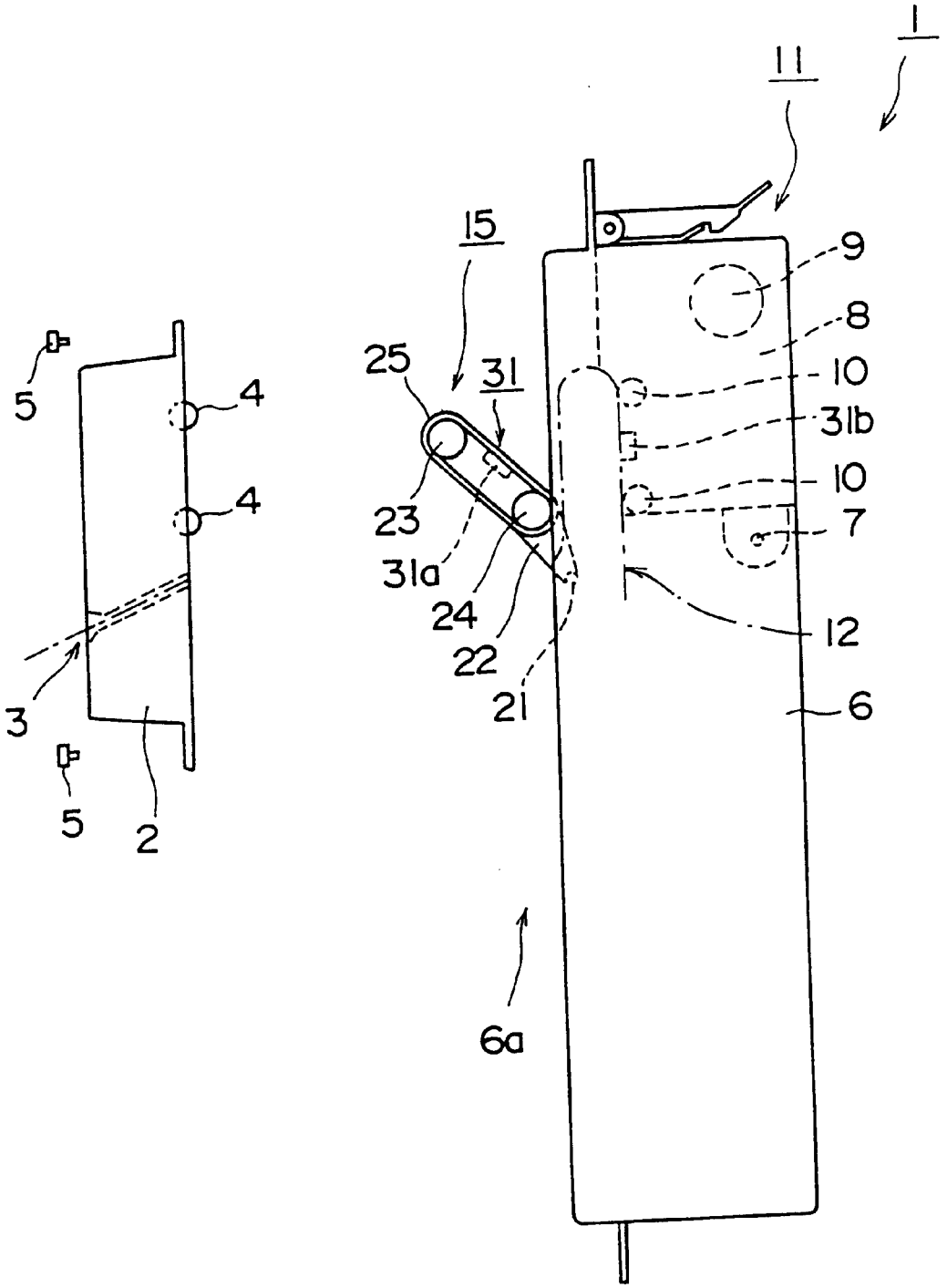
FIG.14 PRIOR ART
FIG. 14 is a perspective plan view showing operation of the conventional bill processor.
Figure 15:
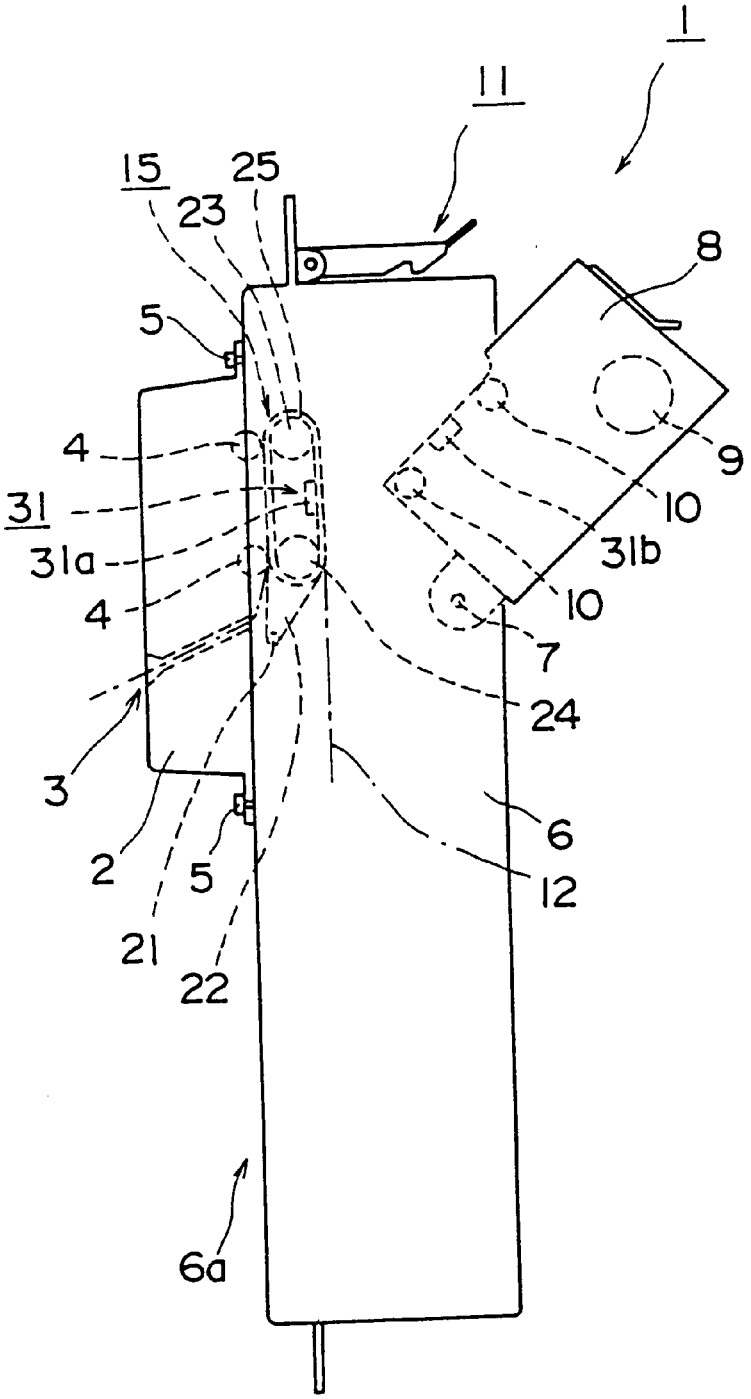
FIG.15 PRIOR ART
FIG. 15 is a perspective plan view showing operation of the conventional bill processor.

Specifically, the bill processor 1 does not have the front mask 42 directly mounted on the machine body 36 by screws like the conventional embodiment (FIG. 14) and do not need the work of removing screws with a tool such as a screwdriver. The front mask 42 can be removed easily from the front 36*a* of the machine body 36.

The pivot stopper means 44 limits the pivot of the front mask 42, so that it is not necessary to support the front mask 42 when an operator changes the conveying belt 25 of the bill conveying means 15 or cleans the bill identification means 31.

When the front 36*a* of the machine body 36 is exposed, an open space for the bill conveying means 15 is formed above the front mask 42. The bill conveying means 15 is pivoted by a predetermined pivoting angle in a counterclockwise direction about the shaft 21 to provide a space for changing the conveying belt 25 above and below the supporting plate 22. And, this space is utilized to change the conveying belt 25, so that the conveying belt 25 can be changed easily.

A space sufficient to insert a cleaning jig such as a cotton swab to remove dirt adhered to the light emitting diode and the light receiving diode is formed above the exposed bill passage 12. This space is used to clean the photosensor as the bill identification means 31, so that the front mask 42 does not disturb the insertion of the cleaning jig such as a cotton swab as compared with the conventional embodiment (FIG. 14), and dirt adhered to the light emitting diode 31*a* and the light receiving diode 31*b* can be removed easily and thoroughly by inserting the cleaning jig such as a cotton swab.

The bill processor 41 of this embodiment according to the first aspect of the invention has the bill identification means 31 and the pivot stopper means 44. But, this configuration is not exclusive. The bill processor 41 not provided with the bill identification means 31 and the pivot stopper means 44 may also be applied.

In the bill processor 41 of this embodiment according to the first aspect of the invention, the front 36*a* of the machine body 36 is wholly covered with the front mask 42. But, this configuration is not exclusive. It is satisfactory by covering the bill conveying means which is disposed on the side of the front 36*a* of the machine body 36.

As described above, in the bill processor according to the first aspect of the invention, the front mask is supported to cover the bill conveying means disposed on the machine body and to be freely pivotable with respect to the machine body. When the conveying belt of the bill conveying means is changed or when the identification means is cleaned, it is not necessary to remove screws with a tool such as a screwdriver in order to remove the front mask. Thus, the change of the conveying belt of the bill conveying means and the cleaning of the bill identification means can be made with ease, and the maintenance and inspection work can be improved remarkably. Accordingly, stably operating automatic vending machines, money-changing machines, or service equipment such as pinball dispensing machines and token dispensing machines can be provided.

A bill processor according to a second aspect of the invention will be described in detail.

As a first embodiment of the bill processor according to the second aspect of the invention, a so-called one escrow type bill processor which temporarily holds one bill in the bill passage in the same way as the bill processor 41 according to the first aspect of the invention, and stores the held bill into the stacker after dispensing merchandise will be described in detail.

Figure 3:
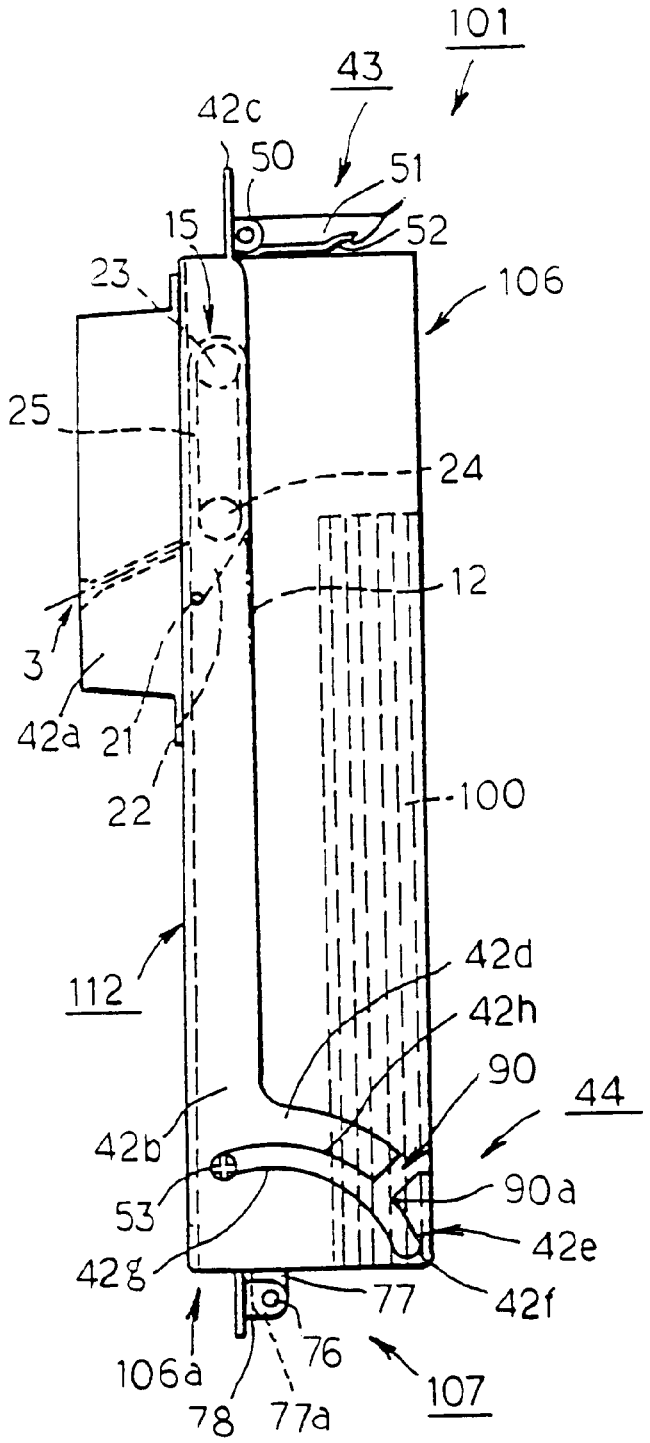
FIG. 3 is a perspective plan view of the bill processor of a first embodiment according to a second aspect of the invention.

FIG. 3 is a schematic side view of the one escrow type bill processor of the first embodiment according to the second aspect of the invention.

A bill processor 101 of the first embodiment according to the second aspect of the invention is an apparatus which is configured by partly modifying the bill processor 41 according to the first aspect of the invention shown in FIG. 1. Specifically, supporting means 107 shown in FIG. 3 is disposed instead of the supporting means 47, the ribs 45 and the shaft 46 held between the ribs 45 of the bill processor 41 according to the first aspect of the invention, and a notch 90 is formed on a tongue piece 42*d* of a front mask 112 to partly open the pivot guide groove 42*e*. In FIG. 3, the same parts as in FIG. 1 are indicated by the same numerals.

Specifically, the bill processor 101 comprises a machine body 106, which has an engaging member 77 configuring supporting means 107 at its bottom end, and the front mask 112, which has the notch 90 and a shaft 76 and a rib 78 forming the supporting means 107.

The engaging member 77 disposed on the machine body 106 is a U-shaped notch member having a notch 77*a* in a circular arc shape to engage with the shaft 76 on the side of a front 106*a* of the machine body 106.

The machine body 106 is a rectangular housing and comprises a bill passage 12, bill conveying means 15, a drive motor 9 (FIG. 1), bill identification means 31 (FIG. 1), a stacker 100 not shown in FIG. 2, first idle rollers 4 (FIG. 1), and second idle rollers 10 (FIG. 1).

The bill conveying means 15, in its initial position same as the initial positions shown in FIG. 1 and FIG. 13, has a support plate 22 positioned and supported at the upper part of the machine body 106 by the latch means which is intervened between the support plate 22 and the machine body 106.

The notch 90 formed on the front mask 112 is a notch with one end open which is formed on a tongue piece 42*d* of the front mask 112 to partly open the pivot guide groove 42*e* and guides a shaft 53 of the machine body 106 along the pivot guide groove 42*e* when the machine body 106 is attached to or removed from the front mask 112.

The shaft 76 disposed on the front mask 112 is supported between the pair of ribs 78 fixed to the tongue pieces extended from the bottom end of the front mask 112.

Accordingly, by the supporting means 107 consisting of the engaging member 77, the shaft 76 and the ribs 78, when a notch 77*a* in a circular arch shape of the engaging member 77 is engaged with the shaft 76, the machine body 106 can be supported so to be freely detachable and also pivotable with respect to the front mask 112.

In the initial position shown in FIG. 3, the machine body 106 supported by the supporting means 107 is positioned and supported on the front mask 112 by the latch means 43.

According to the bill processor 101 described above, when an unillustrated insertion sensor detects that a bill is inserted through a bill insertion port 3, the drive motor 9 (FIG. 1) activates, the drive force of the drive motor 9 (FIG. 1) is transmitted to a lower pulley 24 through unillustrated power transmission means of the machine body 106, and the conveying belt 25 of the bill transmission means 15 is driven to rotate in a clockwise direction. By the rotating action of the conveying belt 25, the inserted bill is held between the conveying belt 25 and the first and second idle rollers 4, 10 (FIG. 1) of the bill conveying means 15 and conveyed along the bill passage 12 to downstream. The bill identification means 31 (FIG. 1) determines truth or falsehood of the inserted bill, and when it is determined that the bill is counterfeit, the drive motor 9 (FIG. 1) rotates in a reverse direction to reversely drive the conveying belt 25, and the bill which was determined as counterfeit is returned from the bill insertion port 3.

When the inserted bill is determined as a genuine bill by the bill identification means 31 (FIG. 1), the conveying belt 25 keeps rotating in a clockwise direction based on the detected signal, so that the bill is further conveyed to downstream of the bill passage 12 and temporarily held in a midpoint of the bill passage 12.

Then, when the drive motor (FIG. 1) is driven based on a dispense completion signal on merchandise by unillustrated control means, the state of holding the one bill is released. Thus, the conveying belt 25 rotates again in a clockwise direction, the held bill is further conveyed to downstream of the bill passage 12 and accumulated in the stacker 100 at the lower part of the machine body 106.

Mounting and dismounting of the front mask 112 and the machine body 106 of the bill processor 101 according to the second aspect of the invention will be described.

FIG. 4 through FIG. 8 are schematic side views showing a procedure of mounting and dismounting the front mask and the machine body of the bill processor according to the second aspect of the invention, in which the same parts as in FIG. 3 are indicated by the same numerals.

Figure 4:
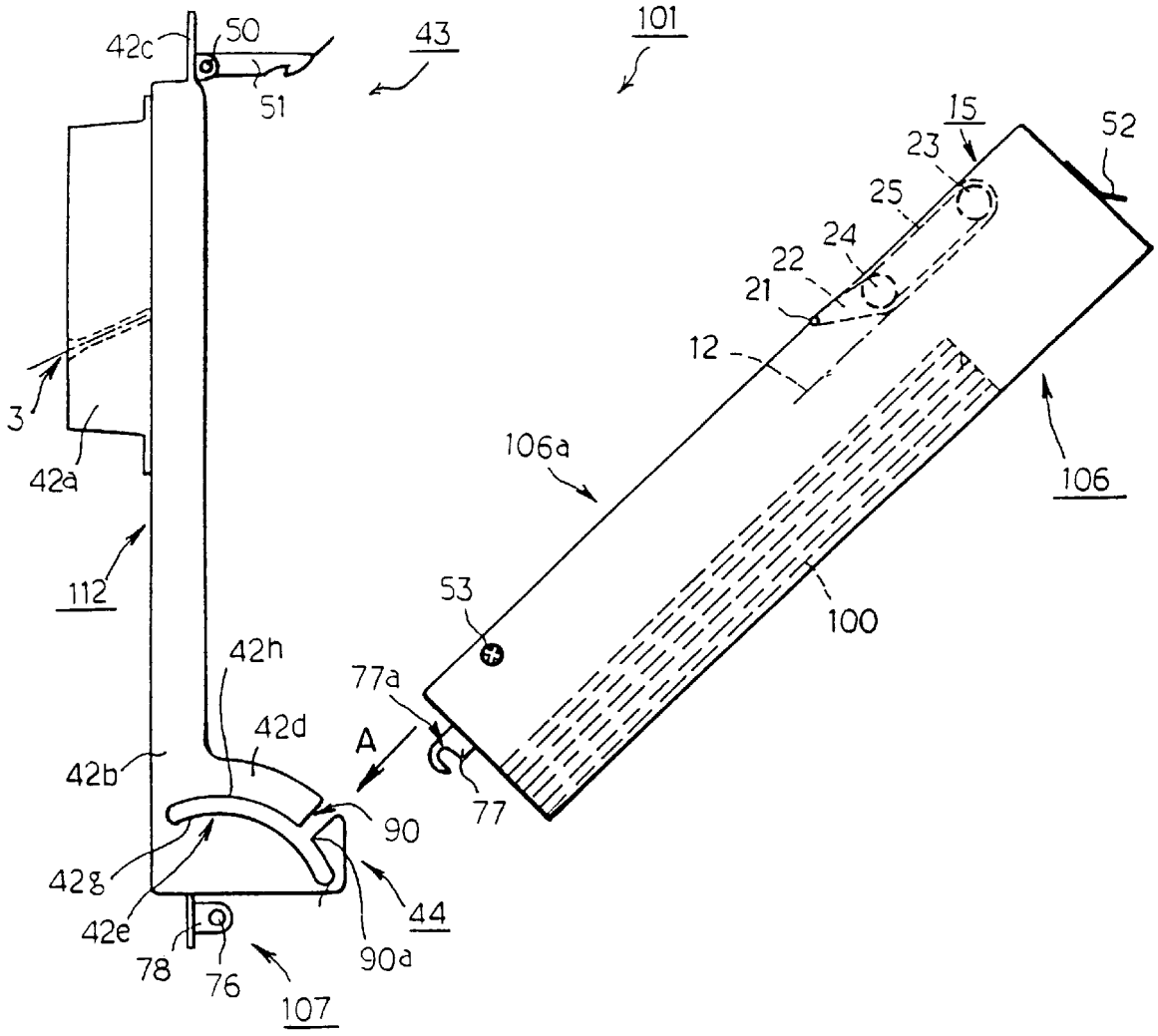
FIG. 4 is a perspective plan view showing a procedure of mounting/dismounting a front mask and a machine body of the bill processor of the first embodiment according to the second aspect of the invention.
Figure 5:
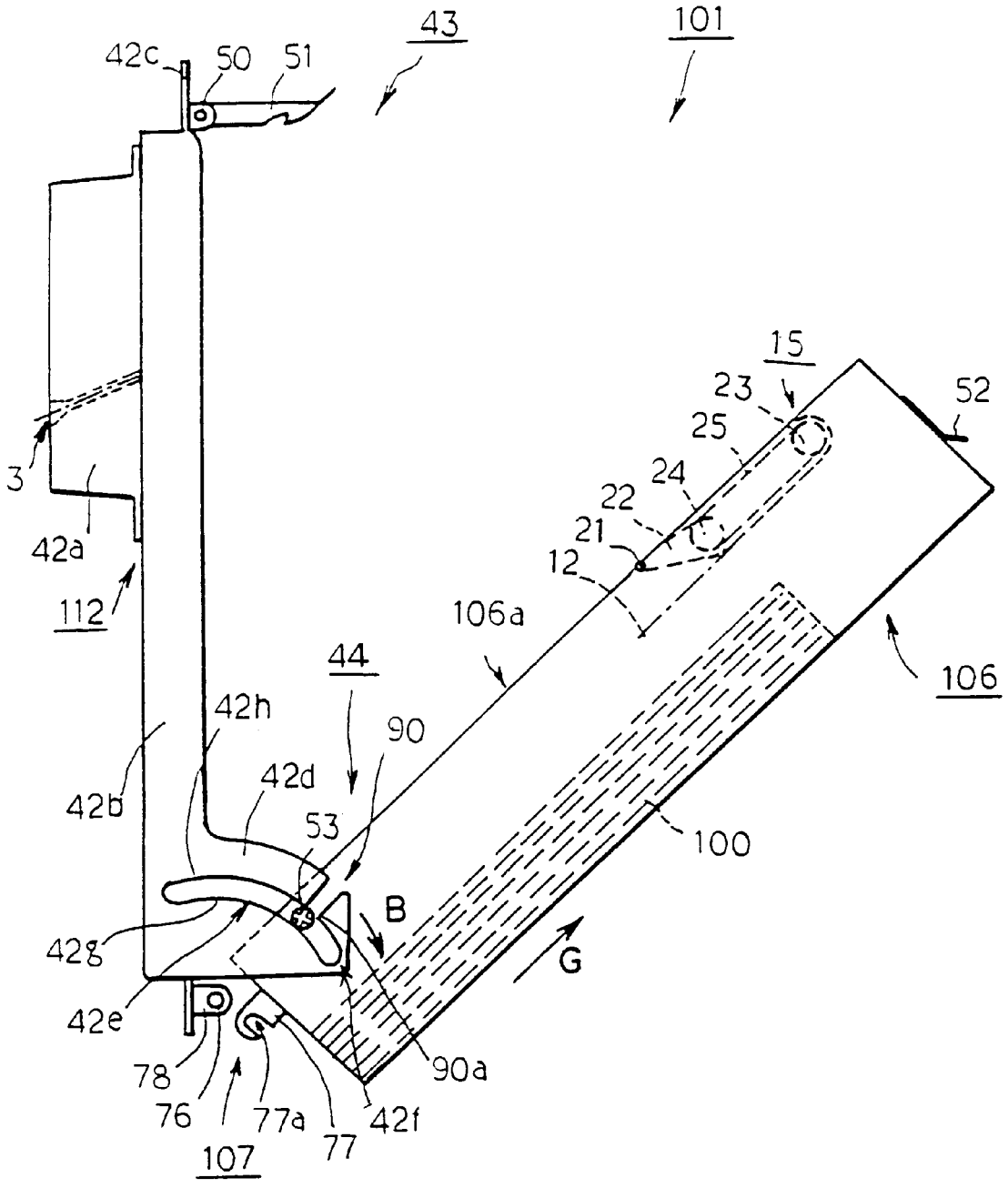
FIG. 5 is a perspective plan view showing the procedure of mounting/dismounting the front mask and the machine body of the bill processor of the first embodiment according to the second aspect of the invention.

In the bill processor 101, when the removed machine body 106 is mounted on the front mask 112 as shown in FIG. 4, the shaft 53 which is formed to protrude from the sides of the machine body 106 is fitted into the notches 90 of the front mask 112 as indicated by arrow A in FIG. 4, and the machine body 106 is moved along the notches 90 until the shaft 53 comes in contact with the pivot guide groove 42*e* formed below the notch 90 as shown in FIG. 5.

Figure 6:
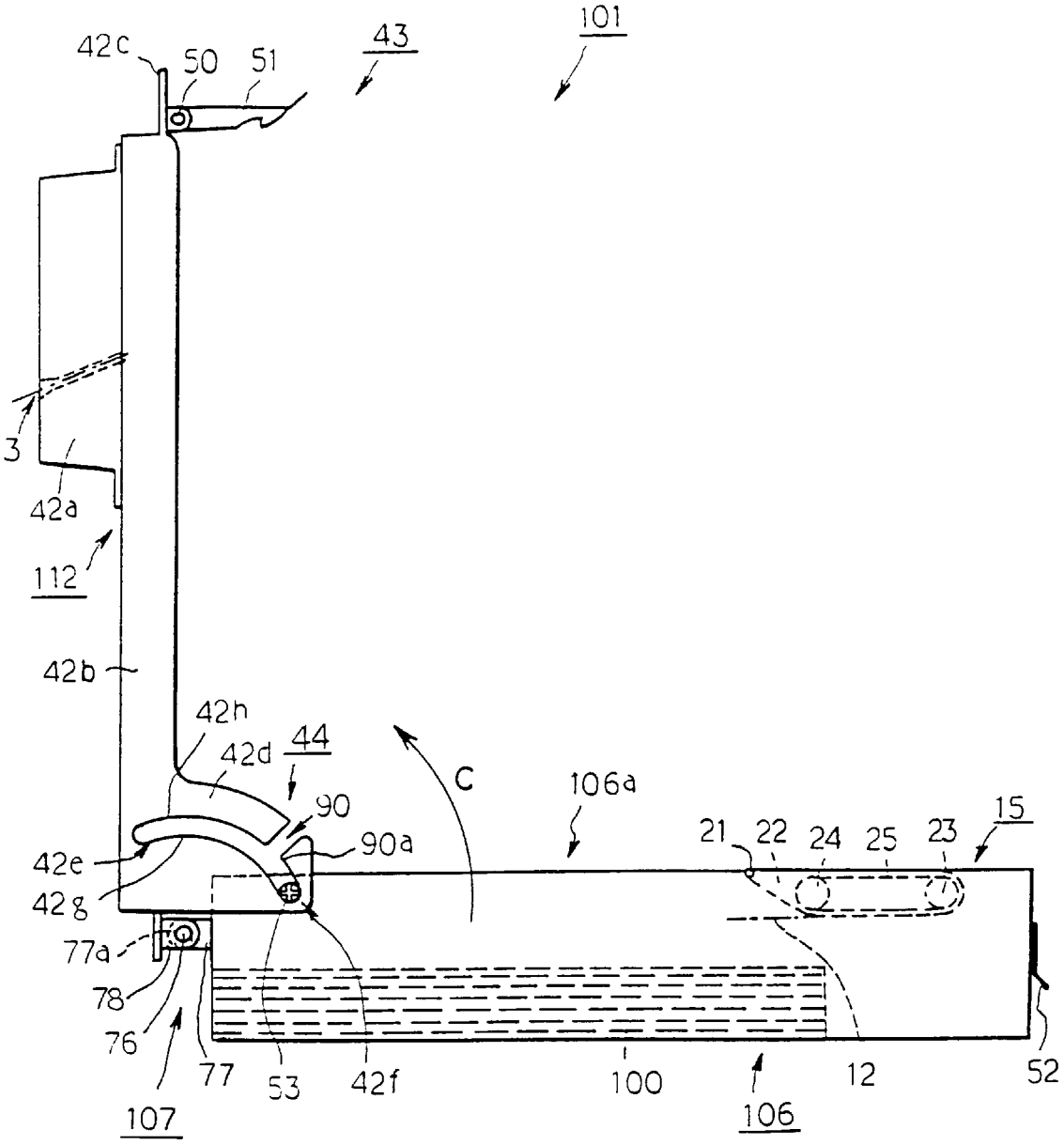
FIG. 6 is a perspective plan view showing the procedure of mounting/dismounting the front mask and the machine body of the bill processor of the first embodiment according to the second aspect of the invention.

The machine body 106 is pivoted in a clockwise direction about the shaft 53, the machine body 106 is moved along an interior 42*g* of the pivot guide groove 42*e* until the shaft 53 which is in contact with the pivot guide groove 42*e* comes in contact with a bottom end 42*f* of the pivot guide groove 42*e* as indicated by arrow B in FIG. 5, and the shaft 76 of the support means 107 is engaged with the engaging member 77 as shown in FIG. 6.

The machine body 106 is then pivoted in a counterclockwise direction about the shaft 76 as indicated by arrow C in FIG. 6, and the engaging hook 51 of the latch means 43 is pivoted in a counterclockwise direction about the shaft 50 to engage with the engaging member 52 of the machine body 106. Thus, the machine body 106 can be mounted on the front mask 112 as shown in FIG. 3.

Figure 7:
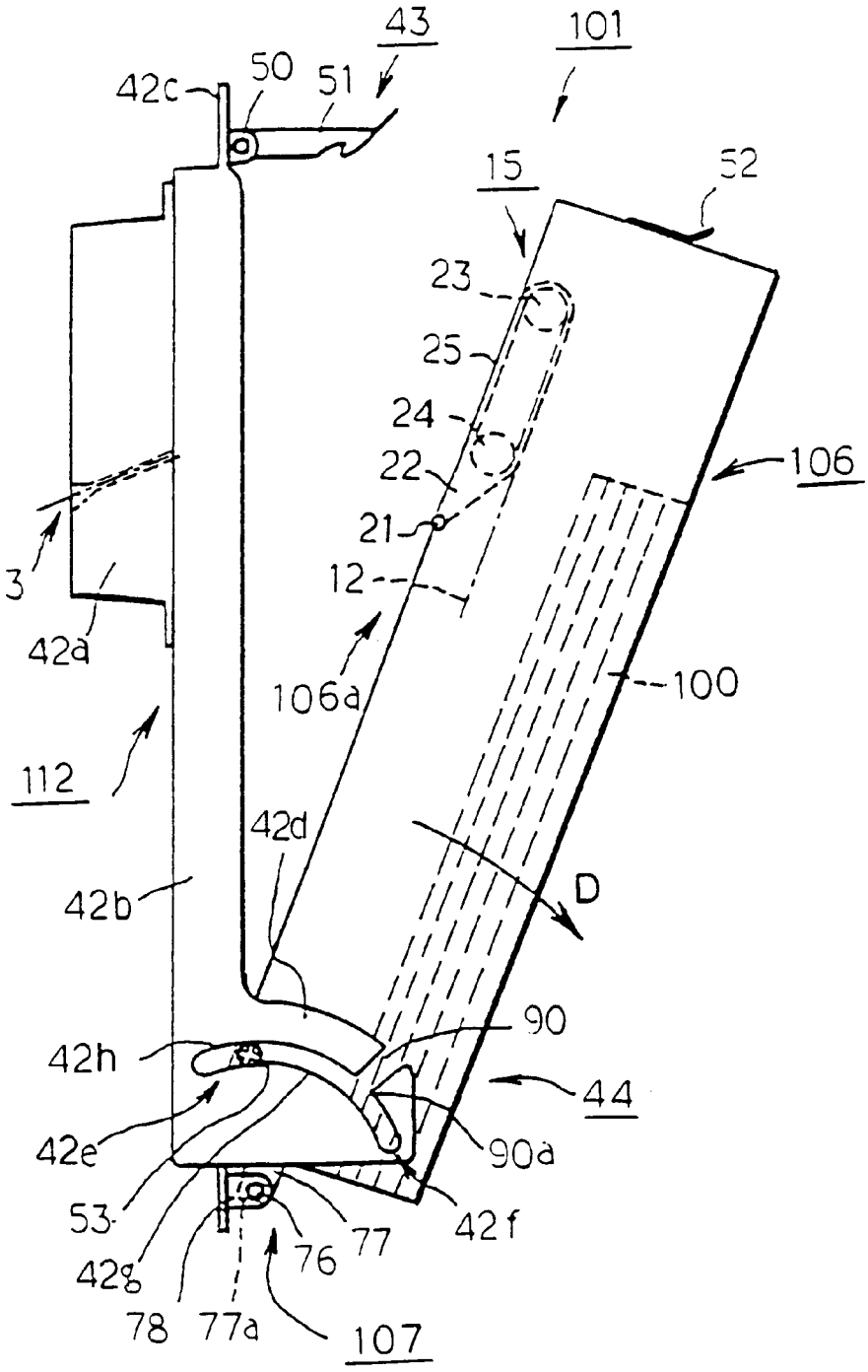
FIG. 7 is a perspective plan view showing the procedure of mounting/dismounting the front mask and the machine body of the bill processor of the first embodiment according to the second aspect of the invention.

When the front mask 112 and the machine body 106 of the bill processor 101 shown in FIG. 3 are separated, the engaging hook 51 of the latch means 43 is pivoted as shown in FIG. 7 in a counterclockwise direction about the shaft 50 to release the engagement with the engaging member 52 of the machine body 106, and the machine body 106 is pivoted in a clockwise direction about the shaft 76 as indicated by arrow D as shown in FIG. 7.

The shaft 53 is moved downward along the pivot guide groove 42*e* until it comes in contact with the bottom end 42*f* of the pivot guide groove 42*e* as shown in FIG. 6.

At this time, an open space is provided for the bill conveying means 15 above the front 106*a* of the machine device 106 in which the bill conveying means 15 is disposed. When the support plate 22 of the bill conveying means 15 is pivoted in a counterclockwise direction about the shaft 21, a space for changing the conveying belt 25 of the bill conveying means 15 is provided above and below the support plate 22. Accordingly, the conveying belt 25 of the bill conveying means 15 can be changed with ease by virtue of these spaces.

And, a space sufficient to remove dirt adhered to the light emitting diode 31*a* (FIG. 1) and the light receiving diode 31*b* (FIG. 1) of the bill identification means 3 (FIG. 1) by inserting a cleaning jig such as a cotton swab is provided above the exposed bill passage 12. When this space is used to clean the photosensor as the bill identification means 31 (FIG. 1), the front mask 112 does not disturb the insertion of the cleaning jig such as a cotton swab as compared with the conventional embodiment (FIG. 14), and the cleaning jig such as a cotton swab can be inserted to readily and fully remove dirt adhered to the light emitting diode 31*a* (FIG. 1) and the light receiving diode 31*b* (FIG. 1).

As shown in FIG. 6, since the machine body 106 has its pivoting limited by the pivot stopper means 44, an operator is not required to support the machine body 106 when the conveying belt 25 of the bill conveying means 15 is changed or when the bill identification means (not shown) is cleaned.

Figure 8:
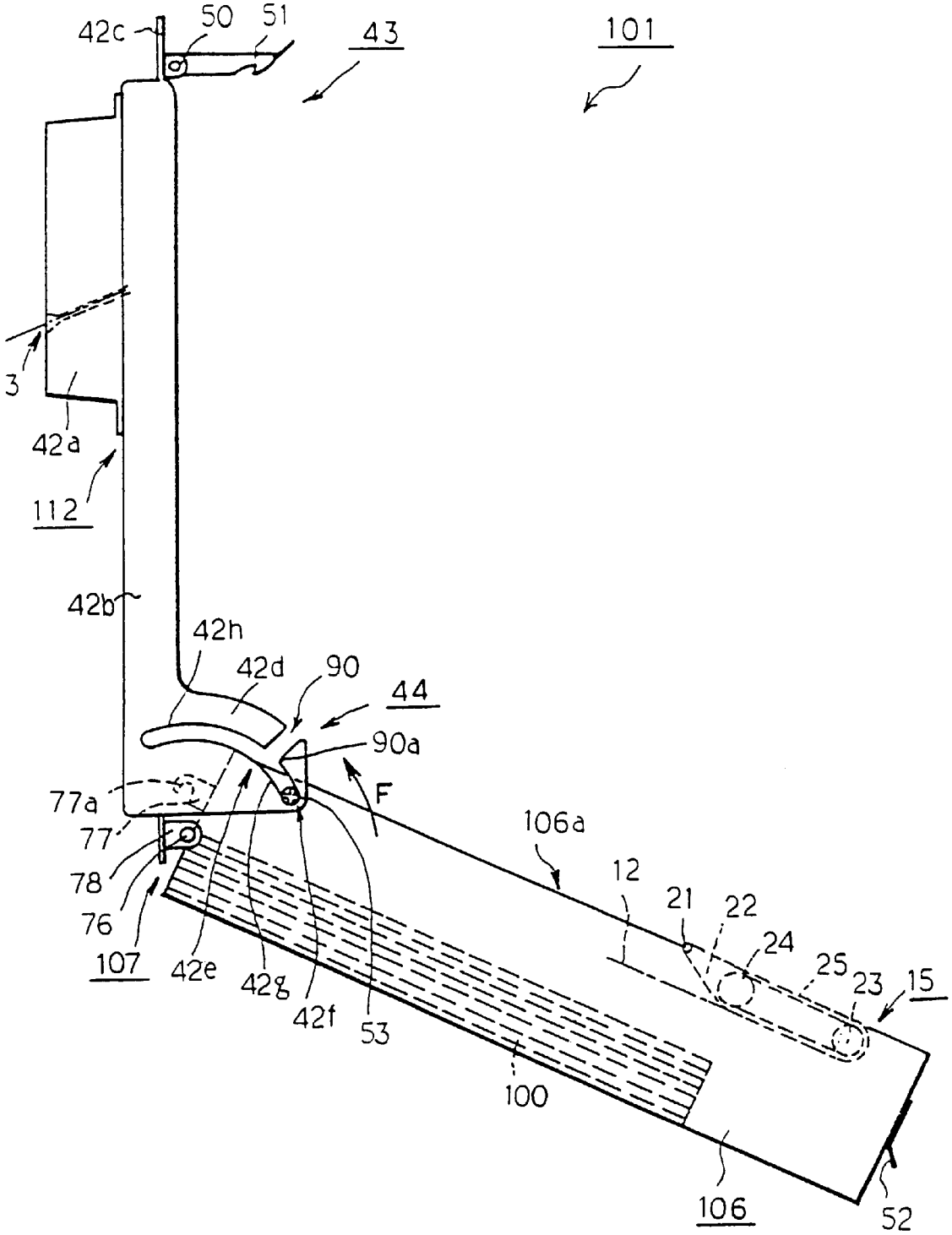
FIG. 8 is a perspective plan view showing the procedure of mounting/dismounting the front mask and the machine body of the bill processor of the first embodiment according to the second aspect of the invention.

As shown in FIG. 8, the machine body 106 is pivoted in a clockwise direction about the shaft 53 which is in contact with the bottom end 42*f* of the pivot guide groove 42*e*, and the engaging member 77 is disengaged from the shaft 76. The machine body 106 is moved along an outer side 42*h* of the pivot guide groove 42*e* until the shaft 53 comes in contact with an edge 90*a* of the notch 90 as indicated by arrow F in FIG. 8. Then, the machine body 106 is moved along the notch 90 until the shaft 53, which is in contact with the edge 90*a* of the notch 90, comes out of the notch 90 as indicated by arrow G in FIG. 5, so that the machine body 106 can be separated from the front mask 112 as shown in FIG. 4.

In the bill processor 101 of the present invention, the machine body 106 is supported to be freely pivotable with respect to the front mask 112, and the support means 107 engages the machine body 106 so to be freely mounted to or dismounted from the front mask 112. Where the bill conveying means 15 disposed in the machine body 106, the bill identification means 31 (FIG. 1), the drive motor 9 (FIG. 1) or the power transmission means (not shown) is repaired for a trouble or inspected for maintenance, the machine body 106 can be removed from the front mask 112, and the machine body 106 which was repaired or inspected for maintenance can be mounted on the front mask 112 with ease.

In an automatic vending machine having the bill processor 101 according to the second aspect of the invention, when any of the bill conveying means 15, the bill identification means 31 (FIG. 1), the drive motor 9 (FIG. 1) and the power transmission means (not shown) disposed in the machine body 106 is repaired for a trouble or inspected for maintenance, the bill processor 101 mounted at a predetermined position of the automatic vending machine is not required to be separated completely from the automatic vending machine body with a tool, but only the machine body 106 can be removed from the front mask 112 mounted in a predetermined position of the automatic vending machine, so that it can be repaired or inspected for maintenance readily.

The bill processor 101 according to the second aspect of the invention has the support means 107 to support the machine body 106 to be freely pivotable with respect to the front mask 112 and to engage the machine body 106 to be freely detachable with respect to the front mask 112. When the front mask 112 is removed from the front 106*a* of the machine body 106, it is not necessary to remove screws by using a tool such as a screwdriver as in the conventional embodiment (FIG. 14), so that the front mask 112 can be removed readily. Therefore, in a bill processor of a type that the bill conveying means 15 is supported by the shaft 21 to be freely pivotable toward the front 106*a* of the machine body 106 and the bill conveying means 15 is covered with the front mask 112 like the bill processor 101 of the first embodiment according to the second aspect of the invention, the change of the conveying belt 25 of the bill conveying means 15 and the cleaning of the bill identification means 31 (FIG. 1) can be made with ease without removing the machine body 106 from the front mask 112.

Specifically, the conveying belt 25 can be changed without removing the machine body 106 from the front mask 112 as follows. The engaging hook 51 of the latch means 43 of the bill processor 101 as shown in FIG. 3 is pivoted in a counterclockwise direction about the shaft 50 to disengage from the engaging member 52 of the machine body 106, and the machine body 106 is pivoted in a clockwise direction about the shaft 76 as indicated by arrow D in FIG. 7, Thus, an open space for the bill conveying means 15 is provided above the front 106*a* of the machine body 106 in which the bill conveying means 15 is disposed, and the support plate 22 of the bill conveying means 15 is pivoted in a counterclockwise direction about the shaft 21, so that a space used for changing the conveying belt 25 of the bill conveying means 15 is formed. And, this space is used to change the conveying belt 25 of the bill conveying means 15.

Thus, a space large enough to remove dirt adhered to the light emitting diode 31*a* (FIG. 1) and the light receiving diode 31*b* (FIG. 1) of the bill identification means 31 (FIG. 1) by inserting a cleaning jig such as a cotton swab is formed above the exposed bill passage 12. This space is used to clean the photosensor as the bill identification means 31 (FIG. 1), so that the bill identification means 31 (FIG. 1) can be cleaned readily without removing the machine body 106 from the front mask 112. And, since the front mask 112 does not prevent the cleaning jig such as a cotton swab from being inserted as in the conventional embodiment (FIG. 14), the cleaning jig such as a cotton swab can be inserted to remove dirt adhered to the light emitting diode 31*a* (FIG. 1) and the light receiving element 31*b* (FIG. 1) with ease.

And, in the bill processor 101 according to the second aspect of the invention, the machine body 106 is freely pivotably supported with respect to the front mask 112 via the supporting means 107, and the machine body 106 is freely detachably engaged with the front mask 112. Therefore, even when a different type of machine body is used, the machine body can be changed readily with respect to the front mask 112 if the machine body has the supporting means 107 in the same configuration. In a case of changing the bill processor of a different type, it is not necessary to wholly change the bill processor 101 including the front mask 112 having the bill insertion port 3 like a conventional case, but the machine body of a different type only can be changed to change the bill processor 101 into a different type.

Figures 9A, 9B, 9C:
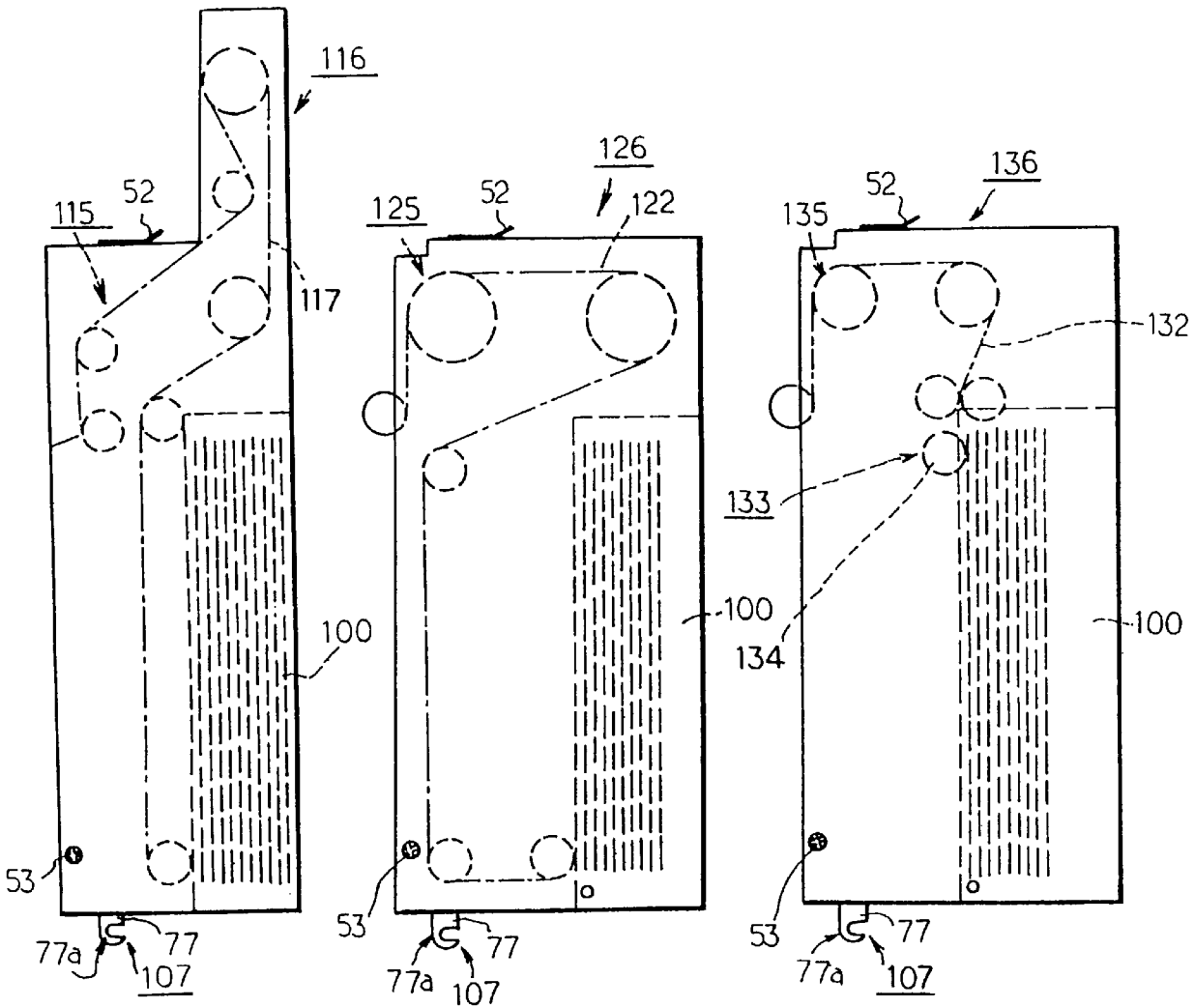
FIGS. 9(*a*) to 9(*c*) are perspective plan views of a machine body configuring the bill processor of second to fourth embodiments according to the second aspect of the invention.

FIGS. 9(*a*) to 9(*c*), in which the same components as in FIG. 3 are indicated by the same numerals, are schematic side views showing various types of machine bodies 116, 126, 136 for configuring various types of bill processors.

The machine body 116 shown in FIG. 9(*a*) comprises a bill passage 117 which extends in a depth direction to have a long bill conveying distance and can hold temporarily three bills therein and bill conveying means 115 which conveys bills along the bill passage 117.

The machine body 126 shown in FIG. 9(*b*) comprises a bill passage 122 which extends in a horizontal direction to have a long bill conveying distance and can hold temporarily three bills therein and bill conveying means 125 which conveys bills along the bill passage 122.

These machine bodies 116, 126 have supporting means 107 having the same size and structure in the same position at the bottom end.

Figure 10:
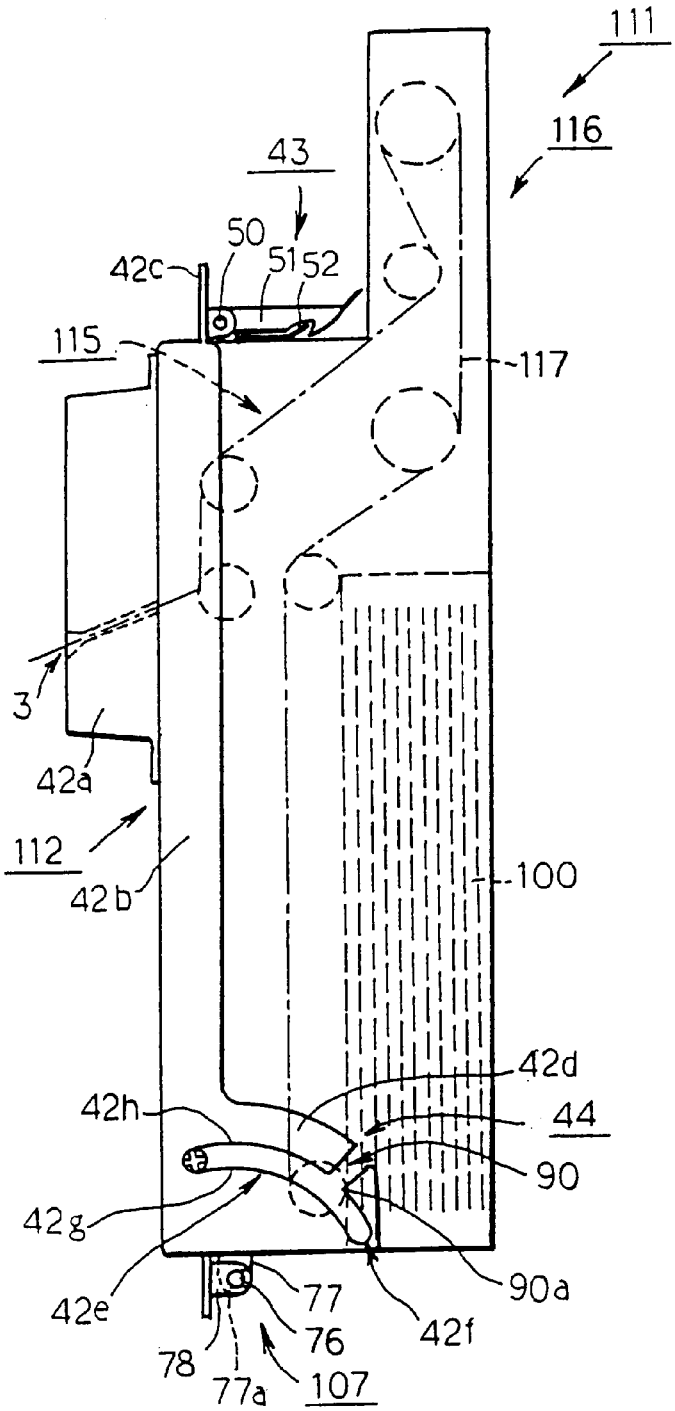
FIG. 10 is a perspective plan view of the bill processor of the second embodiment according to the second aspect of the invention, which is configured of the machine body shown in FIG. 9(*a*)
Figure 11:
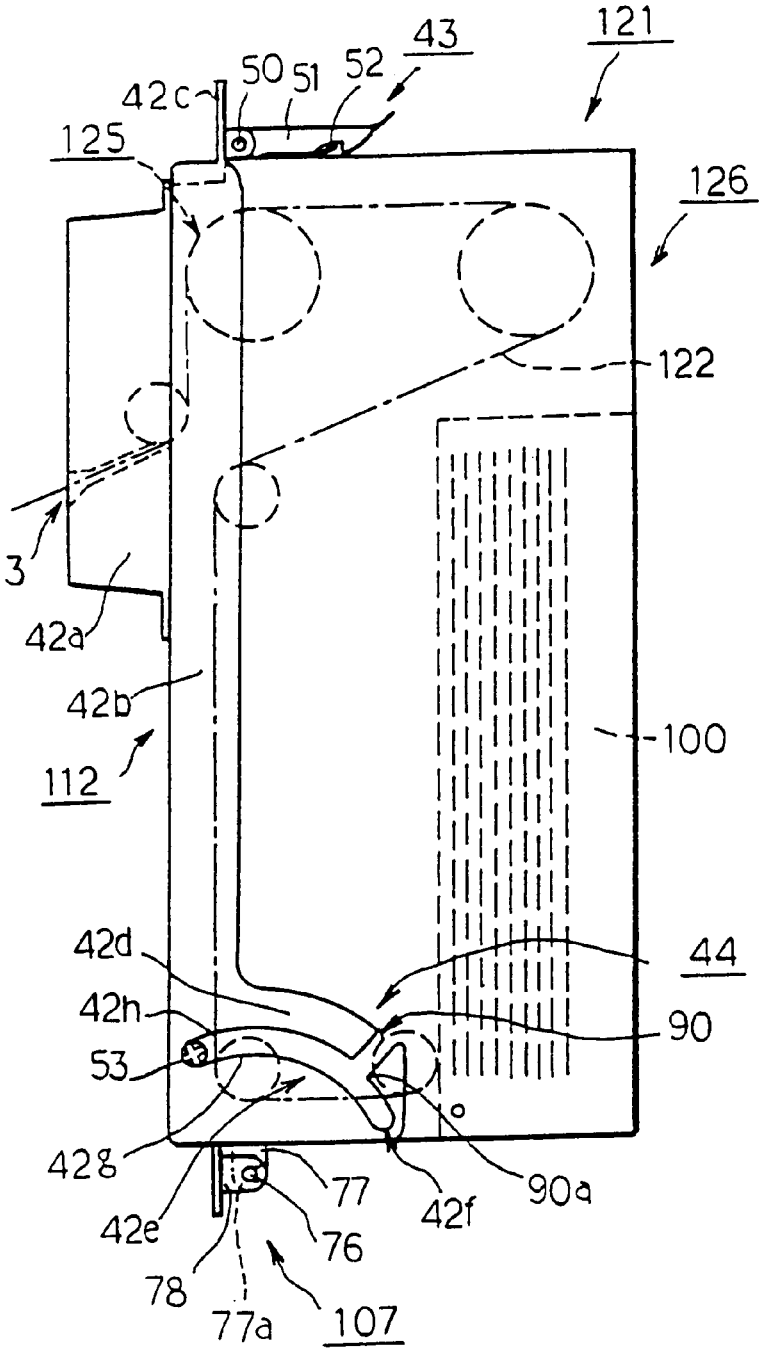
FIG. 11 is a perspective plan view of the bill processor of the third embodiment according to the second aspect of the invention, which is configured of the machine body shown in FIG. 9(*b*)

When the above-described machine bodies 116, 126 are available as option and the one escrow type bill processor 101 shown in FIG. 3 is changed to, for example, a so-called thee escrow type bill processor which holds three bills and accumulates the bills in a stacker after dispensing merchandise, the front mask 112 is held as it is as shown in FIG. 3, and only the machine body 106 is separated from the front mask 112, and the three-bill holding type machine body 116 or 126 shown in FIG. 9(*a*) or FIG. 9(*b*) is mounted on the front mask 112 by the above-described procedure. Thus, as shown in FIG. 10, in which the same components as in FIG. 3 and FIG. 9(*a*) are indicated by the same numerals or FIG. 11, in which the same components as in FIG. 3 and FIG. 9(*b*) are indicated by the same numerals, the one escrow type bill processor 101 can be replaced by the three escrow type bill processor 111 equivalent to the bill processor of the second embodiment according to the second aspect of the invention or the three escrow type bill processor 121 equivalent to the bill processor of the third embodiment according to the second aspect of the invention.

Meanwhile, the machine body 136 shown in FIG. 9(*c*) comprises bill dispensing means 133 consisting of a pickup roller 134 for dispensing bills stored in a stacker 100 and bill conveying means 135.

Figure 12:
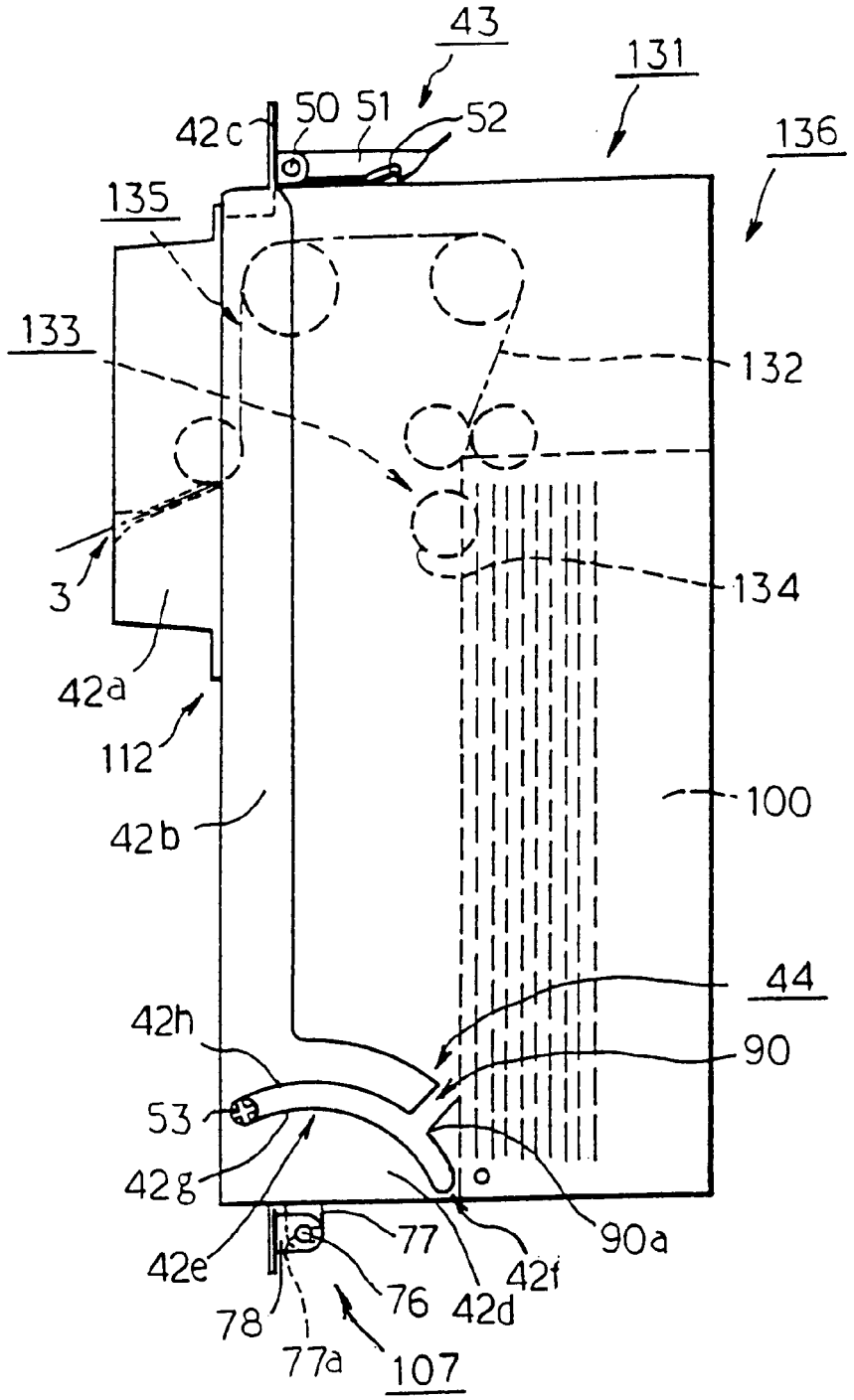
FIG. 12 is a perspective plan view of the bill processor of the fourth embodiment according to the second aspect of the invention, which is configured of the machine body shown in FIG. 9(*c*)

The machine body 136 has supporting means 107, which has the same size and structure as the supporting means 107 disposed in the machine bodies 116, 126, in the same position at the bottom end of the machine body 136. And, reference numeral 132 denotes a bill passage.

Where such a type of machine body 136 is available as option, and when the one escrow type bill processor 101 shown in FIG. 3 is changed to, for example, a bill dispense type bill processor, the machine body 106 of FIG. 3 is removed from the front mask 112, and the machine body 136 having the bill dispensing means 133 shown in FIG. 9(*c*) is mounted on the front mask 112 by the procedure described above. Thus, the change to a dispense type bill processor 131 equivalent to the bill processor of a fourth embodiment according to the second aspect of the invention can be made readily as shown in FIG. 12 in which the same components as in FIG. 3 and FIG. 9(*c*) are indicated by the same numerals.

Thus, when an automatic vending machine has the bill processor 131 according to the second aspect of the invention, various types of machine bodies 106, 116, 126, 136 which are optionally disposed depending on usage can be mounted selectively on the front mask 112 having the same structure and mounted in a predetermined position of the automatic vending machine, so that the automatic vending machine can be modified readily depending on usage.

The bill processor 101 of this embodiment according to the second aspect of the invention has the pivot stopper means 44 but not limited to it. For example, the bill processor 101 may be structured excluding the pivot stopper means 44.

In the bill processor 101 of the first embodiment according to the second aspect of the invention, the bill conveying means 15 is supported by the shaft 21 to be freely pivotable toward the front 36*a* of the machine body 36, and the bill conveying means 15 is covered with the front mask 112 but not limited to it. The bill conveying means 15 may be disposed merely in the machine body 106.

As described above, the bill processor according to the second aspect of the invention has the supporting means which freely pivotably supports the machine body with respect to the front mask and freely detachably engages the machine body with respect to the front mask, so that the machine body can be readily changed to a different type, and the machine body can be changed to a different type by simply changing the machine body without wholly changing the bill processor including the front mask having the bill insertion port like a conventional case.

Therefore, in the bill processor according to the second aspect of the invention, various types of machine bodies can be freely detachably mounted on the same front mask which is mounted in a predetermined position in an automatic vending machine, so that a different type of bill processor can be mounted easily on automatic vending machines, money-changing machines, or service equipment such as pinball dispensing machines and token dispensing machines.

In other words, the bill processor according to the second aspect of the invention can achieve the second object of the invention described above.

The bill processor according to the second aspect of the invention has the supporting means which freely pivotably supports the machine body with respect to the front mask and freely detachably engages the machine body to the front mask. Therefore, where the bill conveying means, the bill identification means, the drive motor or the power transmission means disposed in the machine body is repaired for a trouble or inspected for maintenance, the machine body can be removed from the front mask with ease, and the machine body which was repaired or inspected for maintenance can be mounted on the front mask with ease.

Therefore, in an automatic vending machine having the bill processor according to the second aspect of the invention, where the bill conveying means, the bill identification means, the drive motor or the power transmission means disposed in the machine body is repaired for a trouble or inspected for maintenance, only the machine body can be removed from the front mask mounted in a predetermined position of the automatic vending machine without separating the whole bill processor amounted in a predetermined position of the automatic vending machine by using a tool, so that it can be repaired or inspected for maintenance more readily.

When the bill processor according to the second aspect of the invention is a bill processor of a type that the bill conveying means is freely pivotably supported by the shaft toward the front of the machine body and this bill conveying means covers the front mask, the conveying belt of the bill conveying means can be changed or the bill identification means can be cleaned without separating the machine body from the front mask. And, since it is not necessary to remove screws by using a tool such as a screwdriver from the front mask like the conventional embodiment, the change of the conveying belt of the bill conveying means and the cleaning of the bill identification means can be performed with ease. In other words, the second object of the invention can be achieved and the first object of the invention described above can also be achieved.

Thus, automatic vending machines, money-changing machines, or service equipment such as pinball dispensing machines and token dispensing machines can be repaired or inspected for maintenance efficiently.

The first and second aspects of the invention can be embodied in other various forms without departing from the spirit or major features of the invention. Therefore, the embodiments described above are mere illustrative and not restrictive. The scope of the invention is defined by the claims rather than by the description proceeding them, and all changes that fall within meets and bounds of the claims or equivalence of such meets and bounds are therefore intended to be embraced by the claims.

What is claimed is:

1. A bill processor comprising at least a machine body configured as a housing having at least a bill passage, bill conveying means for conveying a bill along the bill passage, bill identification means for judging truth of falsehood of the inserted bill conveyed along the bill passage and a stacker for accumulating bills which are judged to be genuine bills by the bill identification means; and a front mask having a bill insertion port communicating with the bill passage and covering a front side of the machine body the bill processor further comprising:

supporting means for freely pivotably supporting the machine body with respect to the front mask and freely detachably supporting the machine body with respect to the front mask;

pivot stopper means configured as a an arcuate pivot guiding groove formed in the front mask, and a stopper disposed to protrude from the machine body and fittingly inserted into the pivot guiding groove, for fixing a pivot angle of the machine body with respect to the front mask, by abutting the stopper against an end of the pivot guiding groove; wherein the front mask has a notch for guiding the stopper into the pivot guiding groove.

2. The bill processor according to claim 1, wherein the support structure comprises a shaft pierced through the front mask and an engaging member disposed in the machine body and engaged with the shaft.

3. The bill processor according to claim 1, wherein the machine body is a one bill escrow type machine body for temporarily holding one inserted bill in the bill passage.

4. The bill processor according to claim 1, wherein the machine body is a three bill escrow type machine body for temporarily holding three inserted bills in the bill passage.

5. The bill processor according to claim 1, wherein the machine body has a bill dispenser for dispensing the bills accumulated in the stacker.

6. The bill processor according to claim 1, wherein a latch structure is disposed between the machine body and the front mask to position and support the machine body onto the front mask.

7. A bill processor comprising:

a machine body configured as a housing which has therein at least a bill passage, bill conveying means comprising a conveying belt for conveying a bill along the bill passage, bill identification means for judging truth of falsehood of the inserted bill conveyed along the bill passage and a stacker for accumulating bills which are judged to be genuine bills by the bill identification means, and which supports the bill conveying means to be freely pivotable via a shaft toward a front side;

a front mask which has a bill insertion port communicating with the bill passage and covers the bill conveying means and the front side of the machine body;

supporting means, which freely pivotably supports the machine body with respect to the front mask and freely detachably supports the machine body with respect to the front mask;

pivot stopper means configured as an arcuate pivot guiding groove formed in the front mask, and a stopper disposed to protrude from the machine body and fittingly inserted into the pivot guiding groove, for fixing a pivot angle of the machine body with respect to the front mask, by abutting the stopper against an end of the pivot guiding groove; wherein the front mask has a notch for guiding the stopper into the pivot guiding groove.

8. The bill processor according to claim 7, wherein the bill identification device is disposed to be exposed toward the bill passage.

9. The bill processor according to claim 7, wherein a freely detachable latch structure is disposed between the front mask and the machine body to position and support the machine body onto the front mask.

10. The bill processor according to claim 7, wherein the support structure comprises a shaft pierced through the front mask and an engaging member disposed in the machine body for engaging with the shaft.

11. The bill processor according to claim 7, wherein the machine body is a one bill escrow type machine body for temporarily hold one inserted bill in the bill passage.

12. The bill processor according to claim 7, wherein the machine body is a three bill escrow type machine body for temporarily holding three inserted bills in the bill passage.

13. The bill processor according to claim 7, wherein the machine body has a bill dispenser for dispensing the bills accumulated in the stacker.

* * * * *